US010069220B2

(12) United States Patent
Sudou

(10) Patent No.: US 10,069,220 B2
(45) Date of Patent: Sep. 4, 2018

(54) HEAT-SHRINKABLE TUBE ATTACHMENT JIG, METHOD FOR MANUFACTURING HEAT-SHRINKABLE TUBE-EQUIPPED WIRE, AND HEAT-SHRINKABLE TUBE-EQUIPPED WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Hiroshi Sudou, Mie (JP)

(73) Assignees: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/567,490

(22) PCT Filed: Apr. 20, 2016

(86) PCT No.: PCT/JP2016/062492
§ 371 (c)(1),
(2) Date: Oct. 18, 2017

(87) PCT Pub. No.: WO2016/181779
PCT Pub. Date: Nov. 17, 2016

(65) Prior Publication Data

US 2018/0166799 A1 Jun. 14, 2018

(30) Foreign Application Priority Data

May 11, 2015 (JP) ..... 2015-096534

(51) Int. Cl.
*H01R 4/38* (2006.01)
*H01R 4/72* (2006.01)
(Continued)

(52) U.S. Cl.
CPC ..... *H01R 4/72* (2013.01); *H01R 4/18* (2013.01); *H01R 4/38* (2013.01); *H01B 7/04* (2013.01)

(58) Field of Classification Search
USPC ..... 439/578
See application file for complete search history.

(56) References Cited

U.S. PATENT DOCUMENTS 3,581,084 A * 5/1971 Kaneno ..... B61L 1/025 246/248
4,129,744 A * 12/1978 Cunningham ..... H01R 4/625 174/94 R
(Continued)

FOREIGN PATENT DOCUMENTS

JP H0423061 U 2/1992
JP 2006261065 A 9/2006
(Continued)

OTHER PUBLICATIONS

International Search Report for Application No. PCT/JP2016/062492 dated Jul. 12, 2016; 6 pages.

*Primary Examiner* — Timothy Thompson
*Assistant Examiner* — Krystal Robinson
(74) *Attorney, Agent, or Firm* — Reising Ethington, P.C.

(57) ABSTRACT

A heat-shrinkable tube attachment jig includes a terminal holding portion that holds a plate-shaped counterpart connecting portion of a terminal, a placement portion on which a distal end portion of a heat-shrinkable tube that is located on the counterpart connecting portion side is placed, and a wire holding portion that holds a wire. The placement
(Continued)

portion clamps the distal end portion of the heat-shrinkable tube between the placement portion and a bottom portion of the terminal on which the wire held by the terminal holding portion is arranged. A placement surface of the placement portion on which the distal end portion of the heat-shrinkable tube is placed is disposed at a higher position than a lower surface of the counterpart connecting portion of the terminal held by the terminal holding portion.

7 Claims, 6 Drawing Sheets

(51) Int. Cl.
*H01R 4/18* (2006.01)
*H01B 7/04* (2006.01)

(56) References Cited

U.S. PATENT DOCUMENTS 4,175,257 A * 11/1979 Smith ..... H03F 3/602 330/287
4,354,629 A * 10/1982 Grassauer ..... B23K 3/06 228/106
4,496,094 A * 1/1985 Allen ..... H01R 4/723 228/56.1
4,733,172 A * 3/1988 Smolley ..... G01R 1/07307 324/755.04
4,766,267 A * 8/1988 Gray ..... B29C 61/0616 174/359
5,084,651 A * 1/1992 Farney ..... H01J 23/48 315/39.51
5,118,313 A * 6/1992 Delalle ..... H01R 4/72 439/730
5,127,853 A * 7/1992 McMills ..... H01R 9/053 29/861
5,168,124 A * 12/1992 Takase ..... H01R 4/70 174/23 R
5,218,322 A * 6/1993 Allison ..... H01P 5/12 330/286
5,466,176 A * 11/1995 Cornell ..... H01R 4/40 439/789
5,668,509 A * 9/1997 Hoffmeister ..... H01P 1/047 333/260
5,882,226 A * 3/1999 Bell ..... H01R 9/032 439/582
5,931,698 A * 8/1999 Kodama ..... H01R 9/0527 439/578
6,428,355 B1 * 8/2002 Machado ..... H01R 9/0518 439/578
6,486,414 B2 * 11/2002 Kobayashi ..... H05K 1/0222 174/255
7,463,122 B2 * 12/2008 Kushta ..... H01P 3/06 333/260
8,771,015 B2 * 7/2014 Inoue ..... H01R 4/70 439/604
8,927,863 B2 * 1/2015 Tanikawa ..... H02G 15/04 174/74 A
9,004,957 B2 * 4/2015 Aizawa ..... H01R 12/596 439/876
9,293,838 B2 * 3/2016 Sakaguchi ..... H01R 4/62
9,954,290 B2 * 4/2018 Sudou ..... H01R 4/72
9,980,370 B2 * 5/2018 Kashiwakura ..... H05K 1/0222
2001/0003688 A1 * 6/2001 Kondo ..... B29C 45/14426 439/604
2002/0166689 A1 * 11/2002 Maetani ..... H01L 23/49838 174/521
2006/0097906 A1 * 5/2006 Heide ..... G01S 7/032 342/22
2006/0191904 A1 * 8/2006 Kirby ..... H01R 4/72 219/541
2007/0149065 A1 * 6/2007 Cecil ..... H01R 4/646 439/730
2008/0291115 A1 * 11/2008 Doan ..... H01Q 1/38 343/893
2009/0223041 A1 * 9/2009 Garrison ..... H01R 12/63 29/755
2011/0048762 A1 * 3/2011 Sawamura ..... B60R 16/0207 174/78
2011/0308857 A1 * 12/2011 Zapata ..... H01R 4/183 174/88 R
2012/0318554 A1 * 12/2012 Koto ..... H01R 4/625 174/90
2012/0322303 A1 * 12/2012 Charpentier ..... H01R 9/0518 439/578
2013/0126234 A1 * 5/2013 Ono ..... H01R 4/72 174/75 R
2014/0230996 A1 8/2014 Saito
2016/0148720 A1 * 5/2016 Kanagawa ..... B60L 11/14 174/115
2018/0069329 A1 * 3/2018 Sudou ..... H01R 4/72

FOREIGN PATENT DOCUMENTS

JP 2008176970 A 7/2008
JP 2013114936 A 6/2013

* cited by examiner

HEAT-SHRINKABLE TUBE ATTACHMENT JIG, METHOD FOR MANUFACTURING HEAT-SHRINKABLE TUBE-EQUIPPED WIRE, AND HEAT-SHRINKABLE TUBE-EQUIPPED WIRE

CROSS REFERENCE TO RELATED APPLICATIONS

This application claims the priority of Japanese patent application JP2015-096534 filed on May 11, 2015, the entire contents of which are incorporated herein.

TECHNICAL FIELD

The present invention relates to a technique for attaching a heat-shrinkable tube to a connecting portion between a wire and a terminal.

BACKGROUND ART

Patent Document 1 (JP 2013-114936A) discloses a technique for suppressing, when a heat-shrinkable tube is attached to a connecting portion between a wire and a terminal, a hotmelt provided inside the heat-shrinkable tube from flowing to a counterpart connecting end portion of the terminal.

Patent Document 1 discloses a heat-shrinkable tube assembly method including a step in which a terminal is fitted to a terminal fitting recess of a lower frame, a step in which a heat-shrinkable tube including a hotmelt on the inside is externally fitted to a core wire crimped portion of the terminal that has been led out from the lower frame, and the tube end portion is abutted against a blocking wall portion of the lower frame, a step in which an upper frame coupled to the lower frame covers the terminal fitting recess, and a step in which a clamp lever included in a base clamps the lower frame and the upper frame.

SUMMARY

In the configuration of Patent Document 1, a distal end portion of the heat-shrinkable tube is sandwiched between a tube fixing pawl and the terminal. However, the tube fixing pawl merely clamps the heat-shrinkable tube between itself and the back surface of the terminal. Therefore, if the clamping force is insufficient, the hotmelt may flow out from the distal end portion of the heat-shrinkable tube on the terminal back surface side during heat treatment, and flow out to the counterpart connecting portion side. In this case, the solidified hotmelt may become an obstruction when connecting the counterpart connecting portion to the connection target area, and result in poor connection.

Therefore, it is an object of the present application to provide a technique for appropriately connecting a counterpart connecting portion of a terminal of a heat-shrinkable tube-equipped wire to a connection target area.

In order to solve the above-described problem, a first aspect is directed to a heat-shrinkable tube attachment jig that is used when a heat-shrinkable tube is to be attached to a connecting portion between a wire and a terminal of a terminal-equipped wire, the heat-shrinkable tube attachment jig including: a terminal holding portion that holds a plate-shaped counterpart connecting portion of the terminal that is exposed from the heat-shrinkable tube; and a placement portion on which a distal end portion of the heat-shrinkable tube that is located on the counterpart connecting portion side is placed, wherein the placement portion clamps the distal end portion of the heat-shrinkable tube between the placement portion and a bottom portion of the terminal on which the wire is arranged, and a placement surface of the placement portion on which the distal end portion of the heat-shrinkable tube is placed is located on an arrangement surface side of the terminal on which the wire is arranged, relative to a lower surface of the counterpart connecting portion of the terminal held by the terminal holding portion.

According to a second aspect, the heat-shrinkable tube attachment jig according to the first aspect further includes a wire holding portion that holds the wire.

According to a third aspect, the heat-shrinkable tube attachment jig according to the first or second aspect further includes an end face abutment portion that is abutted against an end face of the heat-shrinkable tube that faces the counterpart connecting portion side of the terminal.

According to a fourth aspect, in the heat-shrinkable tube attachment jig according to any one of the first to third aspects, an opening is formed in a portion that opposes the heat-shrinkable tube.

A fifth aspect is directed to a method for manufacturing a heat-shrinkable tube-equipped wire that uses the heat-shrinkable tube attachment jig according to any one of the first to fourth aspects, the method including: (a) a terminal holding step of holding the counterpart connecting portion with the terminal holding portion; (b) a wire holding step of holding the wire with the wire holding portion; (c) a placing step of placing, on the placement portion, the distal end portion of the heat-shrinkable tube that is located on the counterpart connecting portion side; and (d) a step of heat-shrinking the heat-shrinkable tube, wherein the step (c) includes a step of pressing, against the placement portion, the bottom portion of the terminal on which the wire is arranged, in the terminal-equipped wire held in the step (a) and the step (b), thereby clamping the distal end portion of the heat-shrinkable tube between the bottom portion and the placement portion.

A sixth aspect is directed to a heat-shrinkable tube-equipped wire in which a heat-shrinkable tube is attached to a connecting portion between a wire and a terminal of a terminal-equipped wire, wherein the terminal includes a plate-shaped counterpart connecting portion that is exposed from the heat-shrinkable tube and is integrally molded with the wire connecting portion, a flat surface is formed at a distal end portion of the heat-shrinkable tube that is located on the counterpart connecting portion side, at a portion that comes into contact with a bottom portion of the terminal on which the wire is arranged, the flat surface of the heat-shrinkable tube is formed at a higher position than a bearing surface, relative to the arrangement surface of the terminal on which the wire is arranged, the bearing surface coming into contact with a connection target area when the counterpart connecting portion is connected to the connection target area via a connecting member.

According to a seventh aspect, the heat-shrinkable tube-equipped wire according to the sixth aspect includes a coupling portion that couples the wire connecting portion of the terminal and the counterpart connecting portion such that the wire connecting portion is located higher than the counterpart connecting portion, relative to the arrangement surface.

With the heat-shrinkable tube attachment jig according to the first to fourth aspects, the heat-shrinkable tube can be firmly held by sandwiching the heat-shrinkable tube between the terminal and the placement portion. This makes it possible to more reliably position the heat-shrinkable tube.

In addition, since the placement surface of the placement portion is located on the arrangement surface relative to the lower surface of the counterpart connecting portion, the heat-shrinkable tube can be more firmly clamped between the terminal and the placement portion. Further, clamping the heat-shrinkable tube with the terminal and the placement portion makes it possible to reduce the outflow of the waterproofing agent provided inside the heat-shrinkable tube to the counterpart connecting portion on the lower surface side of the terminal. This makes it possible to reduce the impediment to the fixation of the counterpart connecting portion to a fixation target area caused by the waterproofing agent that has flown out and solidified.

With the heat-shrinkable tube attachment jig according to the second aspect, holding the wire with the wire holding portion makes it easy to press the terminal against the placement portion, with the distal end portion of the heat-shrinkable tube interposed therebetween.

With the heat-shrinkable tube attachment jig according to the third aspect, the heat-shrinkable tube can be positioned by abutting an end face of the heat-shrinkable tube against the end face abutment portion.

With the heat-shrinkable tube attachment jig according to the fourth aspect, forming an opening makes it possible to reduce the portion of the heat-shrinkable tube that comes into contact with the heated heat-shrinkable tube attachment jig. This can suppress excessive heating of the heat-shrinkable tube, thus suppressing excessive heating of the wire inside the heat-shrinkable tube.

With the method for manufacturing the heat-shrinkable tube-equipped wire according to the fifth aspect, it is possible to reduce the outflow of the waterproofing agent provided inside in the heat-shrinkable tube to the counterpart connecting portion on the lower surface side of the terminal. This makes it possible to reduce the impediment to the fixation of the counterpart connecting portion to a fixation target area caused by the waterproofing agent that has flown out and solidified.

With the heat-shrinkable tube-equipped wire according to the sixth aspect, the flat surface located higher than the bearing surface in contact with the connection target area is formed below the distal end portion of the heat-shrinkable tube. Accordingly, during connection of the counterpart connecting portion to the connection target area, it is possible to reduce contact between the distal end portion of the heat-shrinkable tube and the counterpart connecting portion, thus reducing the occurrence of poor connection.

With the heat-shrinkable tube-equipped wire according to the seventh aspect, a height difference is formed, thus making it easy to set the flat surface formed at the distal end portion of the heat-shrinkable tube at a position higher than that of the lower surface of the counterpart connecting portion. This facilitates formation of the flat surface at a position higher than that of the bearing surface that comes into contact with the connection target area.

DESCRIPTION OF EMBODIMENTS

Hereinafter, a heat-shrinkable tube-equipped wire, a heat-shrinkable tube attachment jig, and a method for manufacturing a heat-shrinkable tube-equipped wire that uses the heat-shrinkable tube attachment jig according to an embodiment will be described.

Heat-Shrinkable Tube-Equipped Wire

Figure 1:
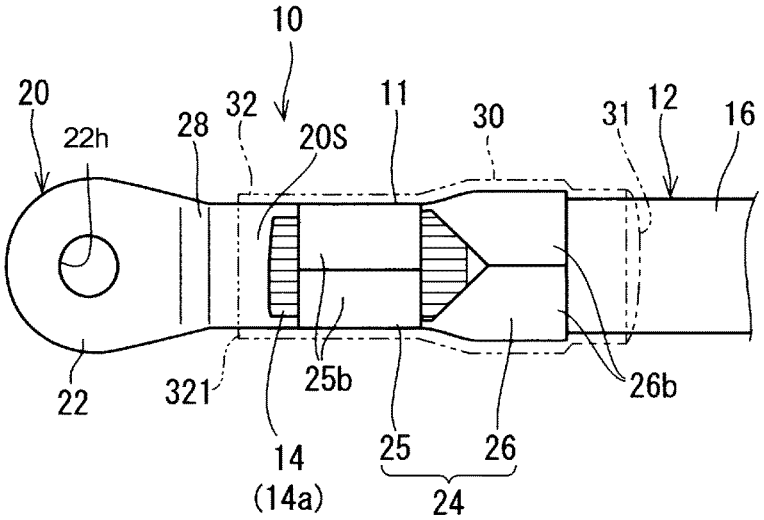
FIG. 1 is a plan view showing a heat-shrinkable tube-equipped wire according to an embodiment.
Figure 2:
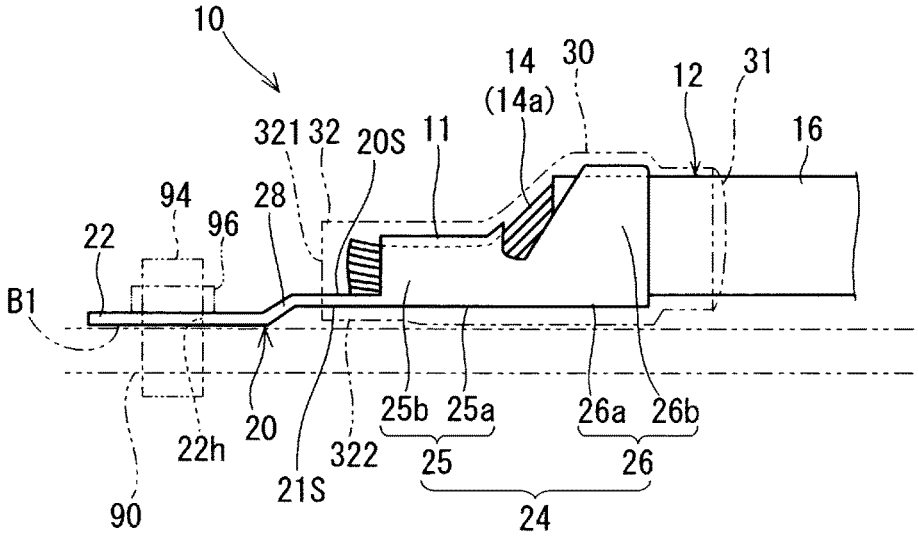
FIG. 2 is a side view showing the heat-shrinkable tube-equipped wire according to the embodiment.

FIG. 1 is a plan view showing a heat-shrinkable tube-equipped wire 10 according to an embodiment. FIG. 2 is a side view showing the heat-shrinkable tube-equipped wire 10 according to the embodiment.

The heat-shrinkable tube-equipped wire 10 includes a wire 12, a terminal 20, and a heat-shrinkable tube 30.

The wire 12 includes a core wire portion 14, and a covering portion 16 that is formed around the core wire portion 14. The core wire portion 14 is formed in a linear shape using a conductive material such as steel, a copper alloy, aluminum, or an aluminum alloy. In the present example, the core wire portion 14 is formed by twisting together a plurality of element wires. Of course, the core wire portion may be constituted by a single wire. The covering portion 16 is formed using an insulating resin material that is extruded around the core wire portion 14 using an extruder or the like. The core wire portion 14 is exposed at a distal end portion of the wire 12, thus forming an exposed core wire portion 14*a* having a predetermined length.

The terminal 20 is a member formed by, for example, pressing a plate material made of copper or a copper alloy, for example. The surface of the terminal 20 may be plated with tin or the like.

The terminal 20 includes a counterpart connecting portion 22, a wire connecting portion 24, and a coupling portion 28.

The counterpart connecting portion 22 is a portion configured to be connectable to a counterpart member to which the terminal 20 is to be connected. In the present example, the counterpart connecting portion 22 is formed in a plate shape. Although the counterpart connecting portion 22 is formed in the shape of a substantially circular plate, it may be formed in the shape of a square plate or the like. The counterpart connecting portion 22 has a hole 22*h* formed therein. A bolt 94 serving as a connecting member is to be inserted through the hole 22*h*. Although the hole 22*h* is formed in a circular shape, the shape of the hole 22*h* is not limited thereto. In the present example, the terminal 20 is assumed to be a ground terminal.

The wire connecting portion 24 includes a core wire crimped portion 25 and a covering crimped portion 26. The covering crimped portion 26 is formed on the opposite side of the counterpart connecting portion 22 relative to the core wire crimped portion 25. The core wire crimped portion 25 is configured such that a pair of crimped pieces 25*b* extend from opposite side portions of a bottom portion 25*a*. Then, the pair of crimped pieces 25*b* are crimped to the exposed core wire portion 14*a* in a state in which the exposed core wire portion 14*a* is arranged on the bottom portion 25*a*. In the following description, at the bottom portion 25*a* of the terminal 20, the surface (the arrangement surface 20S side) side on which the exposed core wire portion 14*a* of the wire 12 is arranged may be referred to as an "upper side" and the side opposite thereto may be referred to as a "lower side".

The covering crimped portion 26 is configured such that a pair of crimped pieces 26*b* extend from opposite side portions of a bottom portion 26*a*. The bottom portion 26*a* is continuous with the bottom portion 25*a*. Then, the pair of crimped pieces 26*b* are crimped to the covering portion 16 in a state in which an end portion of the covering portion 16 is arranged on the bottom portion 26*a*. Consequently, an end portion of the wire 12 is connected to the wire connecting portion 24 of the terminal 20.

Note that the covering crimped portion 26 is not an essential component, and may be omitted. Further, the exposed core wire portion 14*a* may be connected to the wire connecting portion 24 through ultrasonic welding, resistance welding, soldering or the like.

The coupling portion 28 is formed in a plate shape, and couples the counterpart connecting portion 22 and the bottom portion 25*a* of the wire connecting portion 24. The coupling portion 28 is a portion that is bent in a step shape, and couples the counterpart connecting portion 22 and the bottom portion 25*a* of the wire connecting portion 24 such that the lower surface (the lower edge portion of the hole 22*h* of the counterpart connecting portion 22) of the counterpart connecting portion 22 is located below the lower surface of the wire connecting portion 24. Accordingly, the terminal 20 is configured as a stepped terminal in which a height difference is formed between the counterpart connecting portion 22 and the wire connecting portion 24.

The heat-shrinkable tube 30 is a member that covers the connecting portion 11 between the terminal 20 and the wire 12. In the present example, the heat-shrinkable tube 30 is formed as a result of performing heat shrinking in a state in which the heat-shrinkable tube 30 before being heat-shrunk covers the connecting portion 11. Note that the heat-shrinkable tube 30 is obtained by stretching a resin member molded into a tubular shape through extrusion, into the shape of a thick tube in the heated state, and thereafter cooling the resin member. The heat-shrinkable tube 30 obtained in this manner has shape memory properties such that when heated it is shrunk to the shape of a thin tube, i.e., its shape before being stretched.

The heat-shrinkable tube 30 is heat-shrunk into a shape that corresponds with the external shape of the connecting portion 11, and comes into close contact with the surface of the connecting portion 11 as much as possible. In addition, a hotmelt 31 serving as a waterproofing agent is provided inside the heat-shrinkable tube 30. The hotmelt 31 is formed on the entire inner circumferential surface of the heat-shrinkable tube 30, for example. During heat shrinking of the heat-shrinkable tube 30, the hotmelt 31 is softened or melted to fill the gap between the surface of the connecting portion 11 and the inner surface of the heat-shrinkable tube 30 as much as possible. During heat shrinking of the heat-shrinkable tube 30, any excess hotmelt 31 that did not settle within the gap may protrude from an end portion of the heat-shrinkable tube 30. In the present example, the excess hotmelt 31 protrudes outward from an end portion of the heat-shrinkable tube 30 that is located on the covering portion 16 side. Further, at an end portion of the heat-shrinkable tube 30 that is located on the counterpart connecting portion 22 side, the protruding portion of the hotmelt 31 is partly reduced by performing heat shrinking using a heat-shrinkable tube attachment jig 40, which will be described later.

Note that, apart from the hotmelt 31, a thermosetting waterproofing agent, a moisture curable waterproofing agent, or the like may be used as the waterproofing agent. In these cases, the waterproofing agent may be applied to the connecting portion 11 in advance.

The terminal 20 described above is connected to an area serving as a connection target in the following manner. That is, a bolt 94 is provided standing upright on an in-vehicle connection target area 90 (e.g., a grounded area in the vehicle body) that is a connection target. The peripheral edge portion of a portion of the connection target area 90 on which the bolt 94 is provided standing upright is formed as a conductive portion using a metal or the like. Then, a counterpart connecting portion 22 is arranged on the connection target area 90 such that the bolt 94 is inserted through the hole 22*h*. Thereafter, a nut 96 is fastened to the bolt 94, so that the counterpart connecting portion 22 is sandwiched between the connection target area 90 and the nut 96. Consequently, the counterpart connecting portion 22 is fixed in a fixed orientation to the connection target area 90, and the counterpart connecting portion 22 is in contact with the connection target area 90, the bolt 94, and the nut 96. The terminal 20 is electrically connected to the connection target area 90 in the above-described manner. That is, in the present example, the bolt 94 and the nut 96 are examples of a connecting member for connecting the counterpart connecting portion 22 to the connection target area 90.

The terminal 20 comes into contact with the connection target area 90 and the nut 96 in the above-described manner, and is electrically connected to the connection target area 90. Accordingly, if the hotmelt 31 is attached to the surface of the counterpart connecting portion 22, the electrical connection between the counterpart connecting portion 22 and the connection target area 90 or the nut 96 becomes unstable. If the hotmelt 31 is attached to a bearing surface B1 (in the present example, the lower surface of the counterpart connecting portion 22) of the counterpart connecting portion 22 that comes into contact with the connection target area 90, the fixation of the terminal 20 to the connection target area 90 may be impaired.

The heat-shrinkable tube attachment jig 40 described next is a jig for fixing the terminal 20 when heat shrinking the heat-shrinkable tube 30, while suppressing the hotmelt 31 provided thereinside from flowing to the counterpart connecting portion 22 side.

Heat-Shrinkable Tube Attachment Jig

Figure 3:
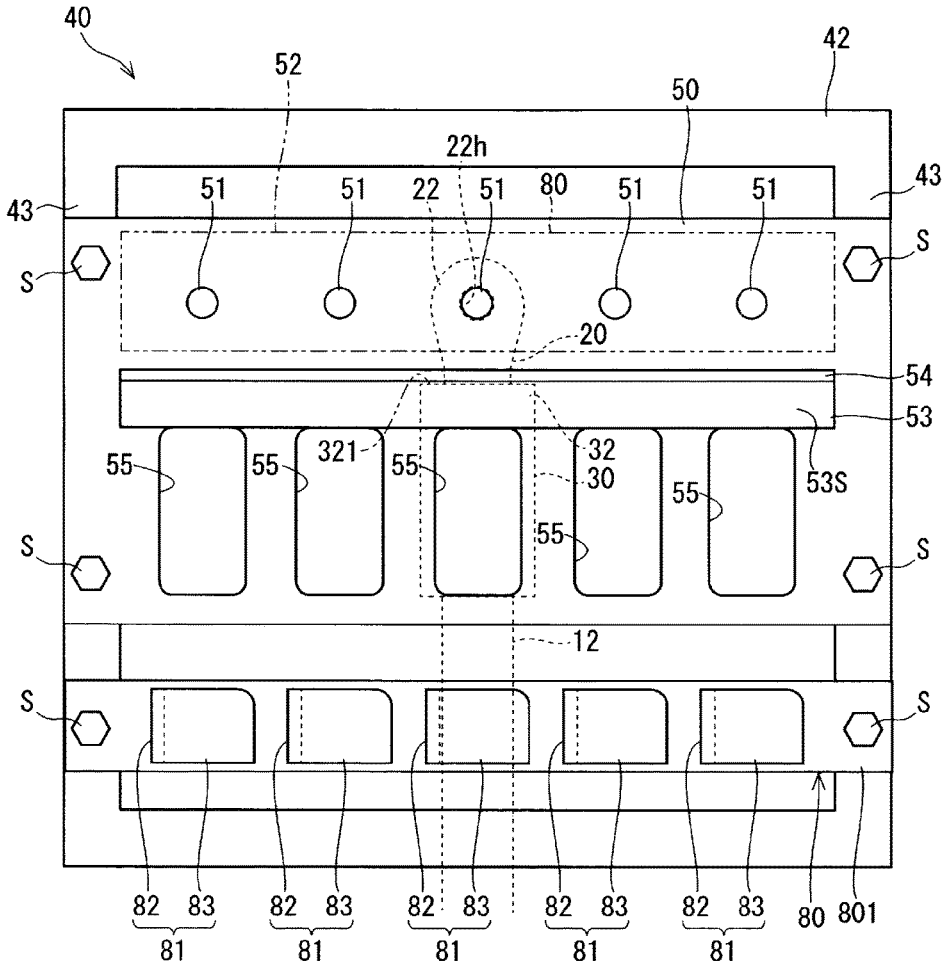
FIG. 3 is a plan view showing the heat-shrinkable tube attachment jig according to the embodiment.
Figure 4:
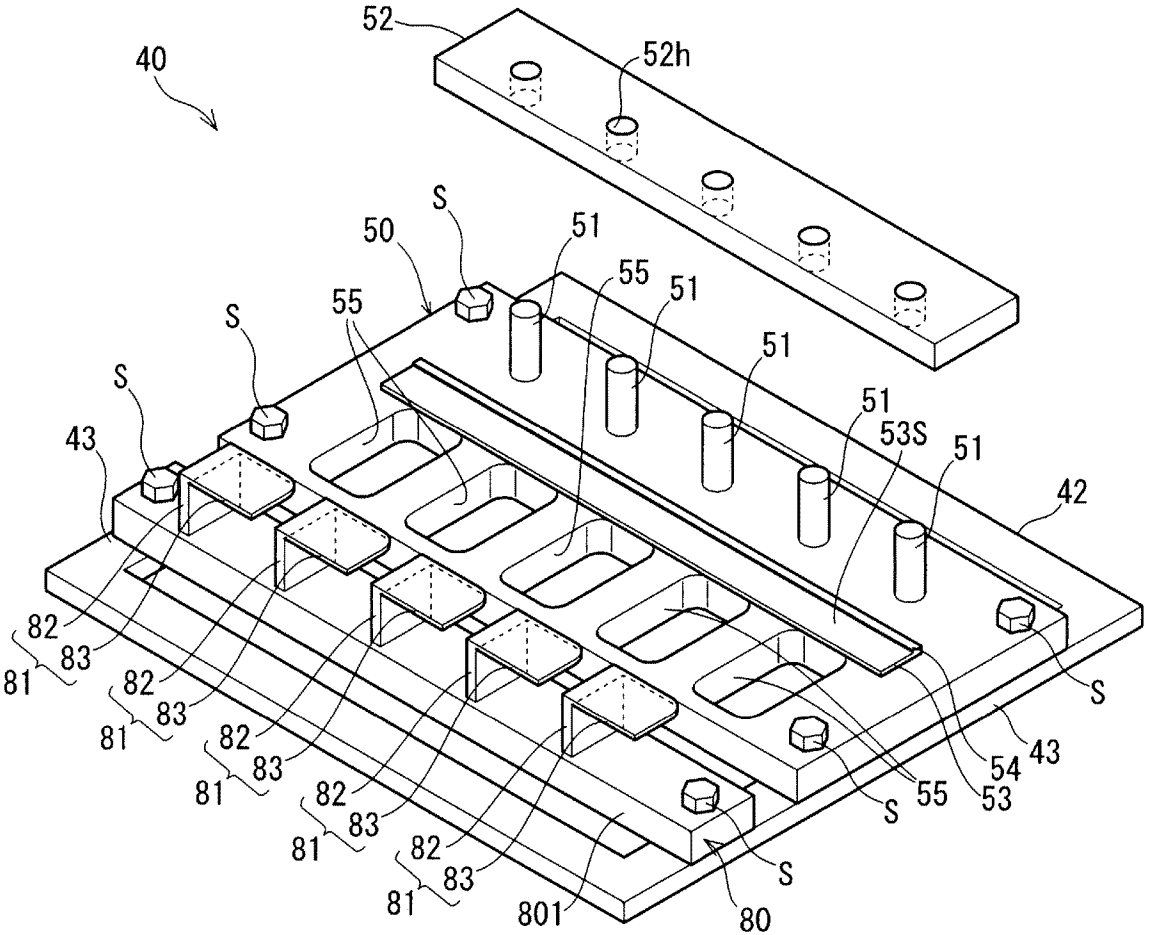
FIG. 4 is a perspective view showing the heat-shrinkable tube attachment jig according to the embodiment.
Figure 5:
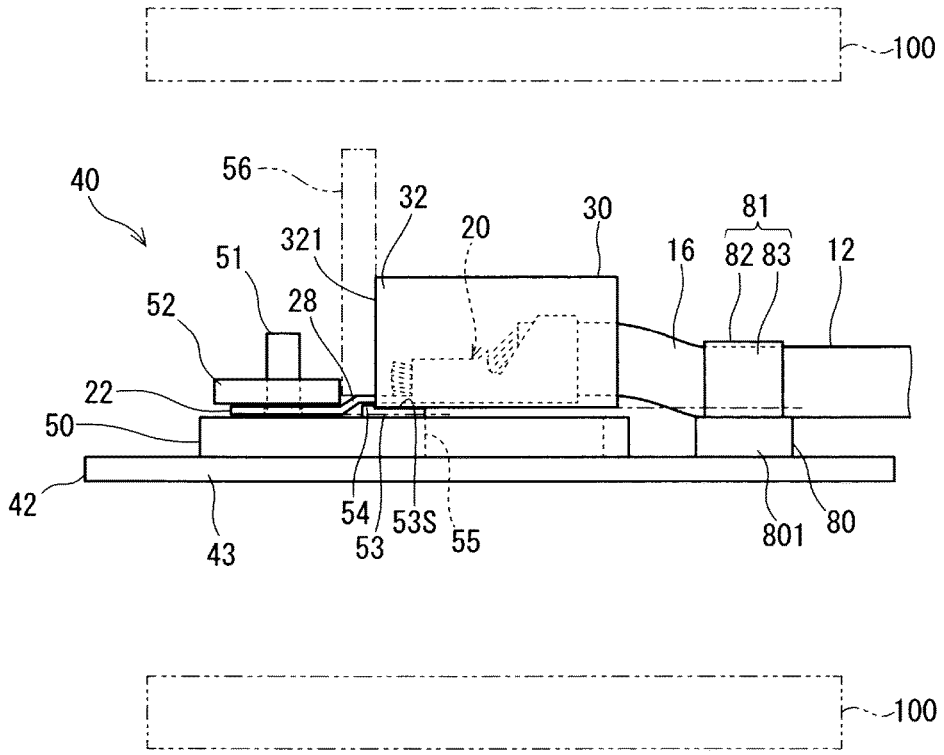
FIG. 5 is a side view showing the heat-shrinkable tube attachment jig according to an embodiment.

FIG. 3 is a plan view showing the heat-shrinkable tube attachment jig 40 according to an embodiment. FIG. 4 is a perspective view showing the heat-shrinkable tube attachment jig 40 according to the embodiment. FIG. 5 is a side view showing the heat-shrinkable tube attachment jig 40 according to the embodiment. Note that the illustration of a screw S has been omitted in FIG. 5.

The heat-shrinkable tube attachment jig 40 is a jig for fixing the terminal 20 when attaching the heat-shrinkable tube 30 to the connecting portion 11 between the wire connecting portion 24 of the terminal 20 and the wire 12. The heat-shrinkable tube attachment jig 40 includes a jig frame 42, a terminal holding portion 50, and a wire holding portion 80.

The jig frame 42 is a member made of a metal or the like, and is formed in the shape of a square frame.

The terminal holding portion 50 is fixed to the jig frame 42. The terminal holding portion 50 is formed in an elongated shape, and spans between a pair of side portions 43 and 43 of the jig frame 42, with opposite end portions thereof being fixed to a plurality of screws S. Preferably, the terminal holding portion 50 is made of a material to which the hotmelt 31 is unlikely to be attached, such as a fluororesin (e.g., Teflon (®)) or an acetal resin (polyacetal). Note that the surfaces of a placement portion 53 and an end face abutment portion 54 may be coated with any of these resins. Alternatively, a portion of the terminal holding portion 50 to which the hotmelt 31 is highly likely to be attached may be formed of any of these resins.

A cylindrical columnar body 51 is provided standing upright on the terminal holding portion 50. The columnar body 51 restricts the movement (more specifically, the movement in a planar direction orthogonal to the direction in which the columnar body 51 extends) of the counterpart connecting portion 22 by being inserted through the hole 22*h* of the counterpart connecting portion 22.

In the present example, a plurality of (here, five) columnar bodies 51 are formed at intervals along the direction in which the terminal holding portion 50 extends. Accordingly, the heat-shrinkable tube attachment jig 40 is configured to simultaneously fix a plurality of (here, five) terminal-equipped wires.

A terminal pressing member 52 is a plate-shaped member made of a metal or the like, and is placed on the counterpart connecting portion 22 of the terminal 20, thereby pressing the terminal 20 against the terminal holding portion 50 and fixing the terminal 20 thereto. The terminal pressing member 52 includes a plurality of holes 52*h* through which a corresponding one of the plurality of columnar bodies 51 can be inserted. As a result of the columnar bodies 51 being inserted through the corresponding holes 52*h*, the movement (more specifically, the movement in a planar direction orthogonal to the direction in which the columnar bodies 51 extend) of the terminal pressing member 52 is restricted.

As described thus far, in the present example, the counterpart connecting portion 22 of the terminal 20 that is exposed from the heat-shrinkable tube 30 of the terminal-equipped wire before being heat-shrunk is held at a fixed position by the columnar bodies 51 and the terminal pressing member 52 of the terminal holding portion 50.

The terminal holding portion 50 includes a placement portion 53 having an elongated shape.

The placement portion 53 has a flat placement surface 53S extending along the direction in which the plurality of columnar bodies 51 are aligned. As shown in FIG. 5, in a state in which a terminal-equipped wire is fixed to the terminal holding portion 50, the placement surface 53S clamps a lower end portion of a distal end portion 32 of the heat-shrinkable tube 30 that is located on the counterpart connecting portion 22 side between itself and the bottom portion 25*a* of the terminal 20 on which the wire 12 (more specifically, the exposed core wire portion 14*a*) is arranged.

Note that the placement surface 53S is located at a height higher than that of the upper surface of the terminal holding portion 50. As a result of the terminal pressing member 52 being mounted to the terminal holding portion 50, the lower surface (the lower edge portion of the hole 22*h* of the counterpart connecting portion 22) of the counterpart connecting portion 22 comes into contact with the upper surface of the terminal holding portion 50. This enables the placement portion 53 to assist in clamping the distal end portion 32 of the heat-shrinkable tube 30, on the placement surface 53S located on the upper side (i.e., the arrangement surface 20S side of the terminal 20) relative to the lower surface of the counterpart connecting portion 22. Accordingly, the heat-shrinkable tube attachment jig 40 of the present example has a structure with which the bottom portion 25*a* of the terminal 20 can be easily pressed against the placement portion 53, with the distal end portion 32 of the heat-shrinkable tube 30 interposed therebetween.

Although the placement portion 53 is formed as a single member in the present example, the placement portion 53 may be divided into a plurality of members, and the plurality of members may be disposed at positions respectively corresponding to the columnar bodies 51, at intervals.

The terminal holding portion 50 includes an end face abutment portion 54 having an elongated shape. In the present example, the end face abutment portion 54 is formed integrally with the placement portion 53 at an end portion of the placement portion 53 as a square block portion protruding to a position higher than the placement surface 53S. Note that the end face abutment portion 54 may be separate from the placement portion 53. In the present example, the dimension of the end face abutment portion 54 in the longitudinal direction is the same as the dimension in the longitudinal direction of the placement portion 53.

The end face abutment portion 54 is abutted against a front end face 321 of the heat-shrinkable tube 30 that faces the counterpart connecting portion 22 side of the terminal 20. As a result of the front end face 321 of the heat-shrinkable tube 30 being abutted against the end face abutment portion 54, it is possible to restrict the movement of the heat-shrinkable tube 30 to the columnar body 51 side relative to the end face abutment portion 54. That is, the movement of the heat-shrinkable tube 30 to the counterpart connecting portion 22 side of the terminal 20 can be restricted by the end face abutment portion 54. Note, however, that the end face abutment portion 54 is not an essential component, and may be omitted.

The terminal holding portion 50 has a plurality of (here, five) openings 55 formed therein. The openings 55 are formed at positions that oppose a heat-shrinkable tube 30. Therefore, in a state in which a terminal-equipped wire is fixed, the portion of the heat-shrinkable tube 30 other than a portion (the distal end portion 32) that is to come into contact with the terminal pressing member 52 is supported so as not to come into contact with the terminal holding portion 50. Accordingly, when heat-shrinking the heat-shrinkable tube 30 using a heater 100, which will be described later, it is possible to suppress excessive heating of the heat-shrinkable tube 30. This can suppress excessive heating of the portion of the wire 12 inside the heat-shrinkable tube 30.

It is desirable that the placement portion 53 and the end face abutment portion 54 are made of a material to which the hotmelt 31 is unlikely be attached, such as a fluororesin or an acetal resin. Note that the surfaces of the placement portion 53 and the end face abutment portion 54 may be coated with any of these resins.

The wire holding portion 80 is configured to hold, at a position away from the terminal holding portion 50, the wire 12 extending from the terminal 20 fixed to the terminal holding portion 50.

More specifically, the wire holding portion 80 includes a plurality of (here, five) holding pieces 81 provided on a plate-shaped portion 801 formed in an elongated shape. The plate-shaped portion 801 spans across a pair of side portions 43 and 43 of the jig frame 42, and is fixed to the jig frame 42 via a plurality of screws S. The length of the plate-shaped portion in the longitudinal direction is set to be the same as the length of the terminal holding portion 50 in the longitudinal direction.

Each of the holding pieces 81 includes a plate-shaped upright portion 82 standing upright from the plate-shaped portion 801 of the wire holding portion 80, and a plate-shaped roof portion 83 extending in a direction intersecting (here, a direction orthogonal to) the direction in which the upright portion extends. In the present example, the roof portion 83 extends parallel to the upper surface of the wire holding portion 80. The distance between the roof portion 83 and the plate-shaped portion 801 is the same as, or slightly smaller than the diameter of the wire 12. As a result of a wire 12 being fitted between the roof portion 83 and the plate-shaped portion 801, the wire 12 is fixed to the holding piece 81.

As shown in FIG. 5, the height of the upper surface of the plate-shaped portion 801 is lower than that of the placement surface 53S of the placement portion 53. Accordingly, the holding piece 81 supports the wire 12 so that the wire 12 bends slightly downward. Consequently, the terminal 20 is pressed against the placement portion 53. Accordingly, the distal end portion 32 of the heat-shrinkable tube 30 is sandwiched between a lower surface 21S of the terminal 20 and the placement surface 53S of the placement portion 53. Thus, the position of the heat-shrinkable tube 30 is fixed. As long as the distal end portion 32 of the heat-shrinkable tube 30 can be sandwiched between the terminal 20 and the placement portion 53, the height of the upper surface of the plate-shaped portion 801 may, of course, be the same as, or higher than the height of the placement surface 53S.

Manufacturing Method

A method for manufacturing the heat-shrinkable tube-equipped wire 10 by using the heat-shrinkable tube attachment jig 40 described above will be described.

First, a terminal-equipped wire to which a heat-shrinkable tube 30 before being shrunk is placed on the connecting portion 11 thereof is prepared. Then, a columnar body 51 of a terminal holding portion 50 is passed through a hole 22*h* of a counterpart connecting portion 22 of the terminal-equipped wire. Additionally, a terminal pressing member 52 is mounted to the terminal holding portion 50. Consequently, as shown in FIG. 5, the terminal 20 is held at a fixed position (terminal holding step).

A wire 12 extending rearward from a terminal 20 attached to the columnar body 51 is attached to a holding piece 81. Consequently, the wire 12 is held at a fixed position (wire holding step).

Subsequently, as shown in FIG. 5, a lower end portion of a distal end portion 32 of the heat-shrinkable tube 30 before being shrunk is placed on a placement surface 53S of a placement portion 53 (placing step). Also, the position of the heat-shrinkable tube 30 is adjusted such that a front end face 321 of the heat-shrinkable tube 30 before being shrunk is in contact with an end face abutment portion 54 (abutting step).

In the placing step, of the terminal-equipped wire held in the terminal holding step and the wire holding step, the bottom portion 25*a* of the terminal 20 on which the wire 12 (more specifically, the exposed core wire portion 14*a*) is arranged is pressed against the placement surface 53S of the placement portion 53. Consequently, the distal end portion 32 of the heat-shrinkable tube 30 is clamped between the bottom portion 25*a* and the placement portion 53.

Subsequently, as shown in FIG. 5, the heat-shrinkable tube 30 placed on the terminal-equipped wire is heated by a heater 100 and heat-shrunk (heat-shrinking step). At this time, the heat-shrinkable tube 30 is shrunk into a shape that conforms with the external shape of the connecting portion 11 as much as possible. Note that, during heating of the heat-shrinkable tube 30, the heat-shrinkable tube attachment jig 40 may be moved so as to approach the heater 100, or the heater 100 may be moved so as to approach the heat-shrinkable tube attachment jig 40.

The hotmelt 31 provided inside the heat-shrinkable tube 30 is softened or melted by heat from the heater 100, thereby filling the gap between the connecting portion 11 and the heat-shrinkable tube 30. Also, the excess portion attempts to flow out from an end portion of the heat-shrinkable tube 30. Meanwhile, the lower end portion of the distal end portion 32 of the heat-shrinkable tube 30 mounted to the heat-shrinkable tube attachment jig 40 of the present embodiment is pressed against the placement portion 53. Accordingly, the hotmelt 31 is suppressed from flowing out from the lower end portion of the distal end portion 32 toward the lower surface side of the counterpart connecting portion 22. Therefore, when connecting the heat-shrinkable tube-equipped wire 10 to the connection target area 90 via the lower surface of the counterpart connecting portion 22, the hotmelt 31 that has flown out can be suppressed from becoming an obstruction in the heat-shrinkable tube-equipped wire 10 after heating is completed.

Note that as shown in FIG. 5, an elongated plate-shaped blocking member 56 may be disposed so as to be in contact with a portion of the front end face 321 of the heat-shrinkable tube 30 that is located on the upper surface (arrangement surface 20S) side of the terminal 20 during the heat-shrinking step. It is desirable that the plate-shaped blocking member 56 is made of a material to which the hotmelt 31 is unlikely to be attached, such as a fluororesin or an acetal resin. By closing the opening of the heat-shrinkable tube 30 on the front-end face 321 side with such a plate-shaped blocking member 56, it is possible to block the outflow of the hotmelt 31 from the front end face 321.

In the heat-shrinkable tube attachment jig 40, a plurality of columnar bodies 51 and a plurality of holding pieces 81 are formed in parallel. This allows a plurality of heat-shrinkable tubes 30 to be collectively heat-shrunk. Accordingly, the attachment of a heat-shrinkable tube 30 to a terminal-equipped wire can be performed efficiently.

Figure 6:
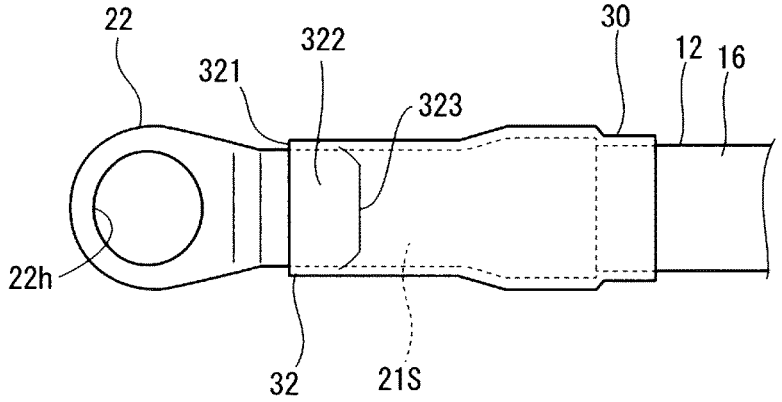
FIG. 6 is a plan view showing the heat-shrinkable tube-equipped wire according to an embodiment.

FIG. 6 is a plan view showing a heat-shrinkable tube-equipped wire 10 according to an embodiment. Note that FIG. 6 is a diagram showing the heat-shrinkable tube-equipped wire 10 as viewed from below. In the heat-shrinkable tube-equipped wire 10, a flat surface 322 is formed at the distal end portion 32 of the heat-shrinkable tube 30, at a portion that is in contact with the bottom portion 25*a* of the terminal 20 on which the wire 12 (more specifically, the exposed core wire portion 14*a*) is arranged. The flat surface 322 is formed to be pressed against the placement surface 53S of the placement portion 53. Further, a bar 323 extending in the width direction of the terminal 20 is formed at the end portion of the flat surface 322 on the wire 12 side. As shown in FIG. 2, the flat surface 322 is formed at a higher position, on the upper side (the arrangement surface 20S side of the terminal 20), than the bearing surface B1 (here, the lower surface of the counterpart connecting portion 22) that comes into contact with the connection target area 90 of the counterpart connecting portion 22. This makes it possible to reduce contact between the distal end portion 32 of the heat-shrinkable tube 30 and the connection target area 90 at the time of connecting the counterpart connecting portion 22 of the heat-shrinkable tube-equipped wire 10 to the connection target area 90. Accordingly, the effect of facilitating connection of the counterpart connecting portion 22 to the connection target area 90 is achieved.

Modification of Wire Holding Portion

Figure 7:
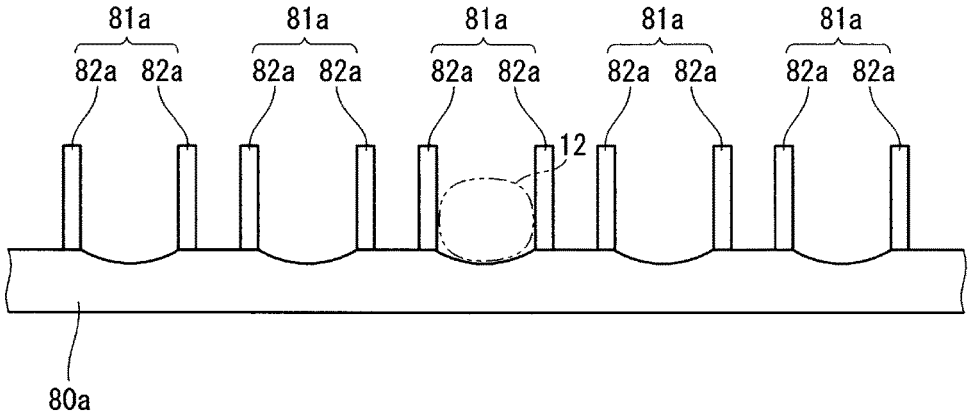
FIG. 7 is a front view showing a wire holding portion according to a modification.

FIG. 7 is a front view showing a wire holding portion 80*a* according to a modification. The wire holding portion 80*a* includes a plurality of (here, five) wire holding groove portions 81*a*. Each of the wire holding groove portions 81*a* is provided at a position at which the wire 12 extending from the terminal 20 fixed to the corresponding columnar body 51 can be held.

Specifically, each of the wire holding groove portions 81*a* includes a pair of wire supporting projections 82*a* and 82*a* provided on the wire holding portion 80*a*. Although not essential, a portion of the wire holding portion 80*a* that is located between the pair of wire supporting projections 82*a* and 82*a* is recessed in an arc shape. The gap between the pair of wire supporting projections 82*a* and 82*a* has a dimension that is the same as, or larger (slightly larger) than the width dimension of the wire 12. The wire holding groove portion 81*a* is open at the top, and the wire 12 is inserted to the inside from the top. Consequently, the wire 12 is held at a fixed position in the width direction thereof.

Modification of Terminal Pressing Member

Figure 8:
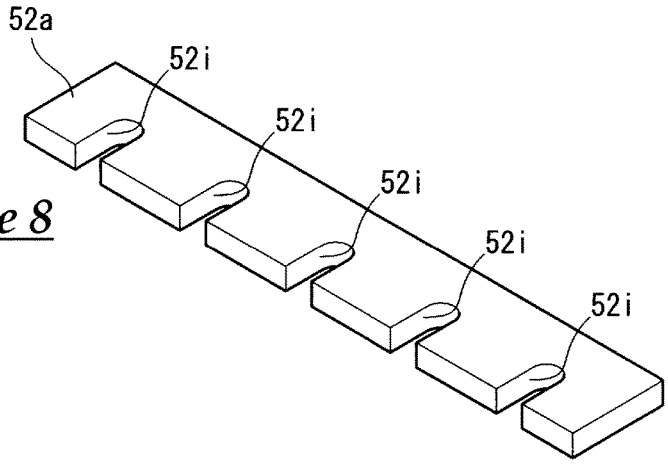
FIG. 8 is a perspective view showing a terminal pressing member according to a modification.

FIG. 8 is a perspective view showing a terminal pressing member 52*a* according to a modification. The terminal pressing member 52*a* is used in place of the terminal pressing member 52. The terminal pressing member 52*a* is an elongated plate-shaped member made of a metal or the like. A plurality of (here, five) grooves 52*i* are formed on one side portion of the terminal pressing member 52*a*. The width of the grooves 52*i* is set to have a dimension that is the same as, or larger (slightly larger) than the diameter of the columnar body 51. At the time of mounting the terminal pressing member 52*a* to the terminal holding portion 50, the columnar bodies 51 are inserted through the corresponding grooves 52*i*. Accordingly, the terminal pressing member 52*a* can be more easily mounted to the terminal holding portion 50 than the terminal pressing member 52.

Modification of Terminal Holding Portion

Figure 9:
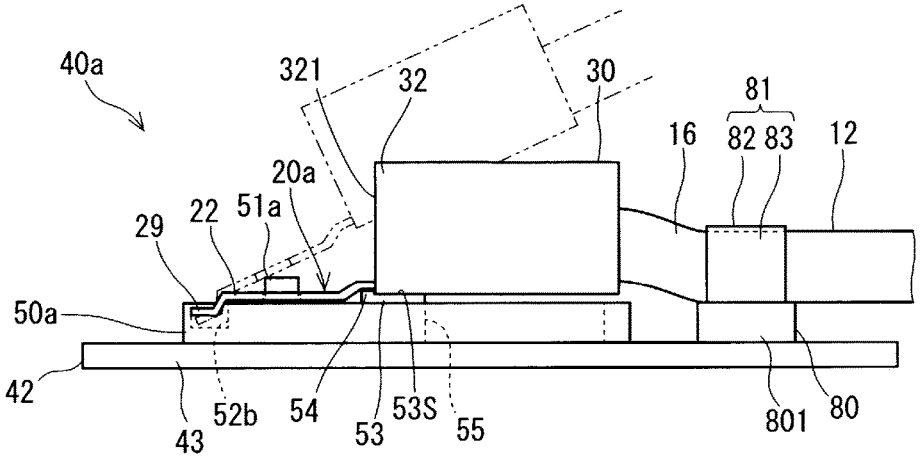
FIG. 9 is a side view showing a heat-shrinkable tube attachment jig according to a modification.

FIG. 9 is a side view showing a heat-shrinkable tube attachment jig 40*a* according to a modification. The heat-shrinkable tube attachment jig 40*a* is configured to fix a terminal 20*a* including a rotation preventing portion 29 formed at a distal end portion of the counterpart connecting portion 22.

More specifically, the rotation preventing portion 29 includes a portion that bends downward from a distal end of the counterpart connecting portion 22 and extends substantially parallel to the counterpart connecting portion 22 beyond the bent portion. A recess 52*b* into which the rotation preventing portion 29 can be inserted is formed on an upper surface of a terminal holding portion 50*a* included in the heat-shrinkable tube attachment jig 40*a*. As indicated by the broken line, the opening width of the recess 52*b* is set to be a width dimension that allows insertion of the distal end portion of the rotation preventing portion 29 in a raised state. The inside of the recess 52*b* has an inner diameter dimension that is larger than the opening width, and is formed such that the rotation preventing portion 29 can be inserted deep into the recess 52*b*.

As a result of the rotation preventing portion 29 being inserted into the recess 52*b*, the distal end portion of the terminal 20*a* is suppressed from rising upward, as indicated by the solid line. Further, as a result of inserting the rotation preventing portion 29 into the recess 52*b*, the terminal 20*a* in a state in which the columnar body 51*a* is inserted through the hole 22*h* is suppressed from rotating about the columnar body 51*a*. If the terminal holding portion 50*a* according to the present modification is used, the terminal pressing member 52 according to the above-described embodiment can be omitted.

As such, the terminal holding portion that holds the terminal in the heat-shrinkable tube attachment jig may have any structure that corresponds with the shape or the like of the terminal.

Modification of Heat-Shrinkable Tube-Equipped Wire

Figure 10:
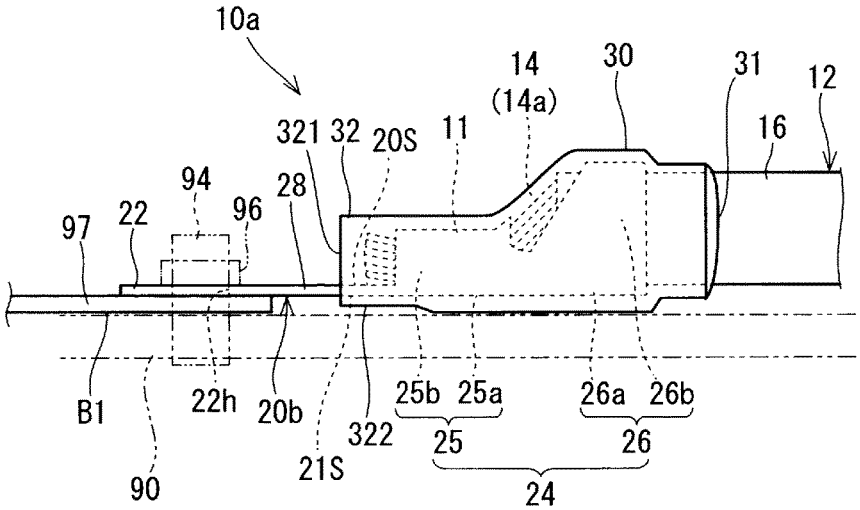
FIG. 10 is a side view showing a heat-shrinkable tube-equipped wire according to a modification.

FIG. 10 is a side view showing a heat-shrinkable tube-equipped wire 10*a* according to a modification. The heat-shrinkable tube-equipped wire 10*a* includes a terminal 20*b* in which the counterpart connecting portion 22 and the bottom portion 25*a* of the core wire crimped portion 25 are formed at the same height. The flat surface 322 at the distal end portion 32 of the heat-shrinkable tube 30 is formed so as to be located below the lower surface of the counterpart connecting portion 22. This positional relationship is different from that of the heat-shrinkable tube-equipped wire 10 shown in FIG. 2.

However, the counterpart connecting portion 22 of the heat-shrinkable tube-equipped wire 10*a* is configured to be connected to the connection target area 90 via the bolt 94 and the nut 96, together with a counterpart terminal 97 to which it is to be connected. Then, the lower surface of the counterpart terminal 97 serves as the bearing surface B1 in contact with the connection target area 90. Thus, the counterpart terminal 97 constitutes, together with the bolt 94 and the nut 96, a connecting member for electrically connecting the counterpart connecting portion 22 to the connection target area 90.

In the present example, the lower surface of the counterpart terminal 97 serves as the bearing surface B1 connected to the connection target area 90. Then, the flat surface 322 of the heat-shrinkable tube-equipped wire 10*a* is disposed on the upper side at a higher position than the bearing surface B1. Accordingly, when connecting the counterpart connecting portion 22 of the heat-shrinkable tube-equipped wire 10*a* to the connection target area 90, it is possible to reduce contact between the distal end portion 32 of the heat-shrinkable tube 30 and a connection target object. Accordingly, the effect of facilitating connection of the counterpart connecting portion 22 to the connection target area 90 is achieved.

The configurations described in the embodiments and modifications above may be appropriately combined as long as they are not mutually inconsistent.

Although embodiments have been described above in detail, the foregoing description is in all aspects illustrative and the invention is not limited thereto. It will be appreciated that numerous modifications not illustrated herein can be made without departing from the scope of the present invention.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10, 10*a* Heat-shrinkable tube-equipped wire
11 Connecting portion
12 Wire
14 Core wire portion
14*a* Exposed core wire portion
16 Covering portion
20, 20*a*, 20*b* Terminal
20S Arrangement surface
21S Lower surface
22 Counterpart connecting portion
22*h* Hole
24 Wire connecting portion
25 Core wire crimped portion
25*a* Bottom portion
25*b* Crimped piece
26 Covering crimped portion
26*a* Bottom portion
26*b* Crimped piece
28 Coupling portion
29 Rotation preventing portion
30 Heat-shrinkable tube
31 Hotmelt
32 Distal end portion
321 Front end face
322 Flat surface
323 Bar
40, 40*a* Heat-shrinkable tube attachment jig
42 Jig frame
43 Side portion
50, 50*a* Terminal holding portion
51, 51*a* Columnar body
52, 52*a* Terminal pressing member
52*b* Recess
52*h* Hole
52*i* Groove
53 Placement portion
53S Placement surface
54 End face abutment portion
55 Opening
56 Plate-shaped blocking member
80, 80*a* Wire holding portion
801 Plate-shaped portion
81 Holding piece
81*a* Wire holding groove portion
82 Upright portion
82*a* Wire supporting protrusion
83 Roof portion
90 Connection target area
94 Bolt
96 Nut
97 Counterpart terminal
100 Heater
B1 Bearing surface

The invention claimed is:

1. A heat-shrinkable tube attachment jig that is used when a heat-shrinkable tube is to be attached to a connecting portion between a wire and a terminal of a terminal-equipped wire, the heat-shrinkable tube attachment jig comprising:

a terminal holding portion that holds a plate-shaped counterpart connecting portion of the terminal that is exposed from the heat-shrinkable tube; and a placement portion on which a distal end portion of the heat-shrinkable tube that is located on the counterpart connecting portion side is placed, wherein the placement portion clamps the distal end portion of the heat-shrinkable tube between the placement portion and a bottom portion of the terminal on which the wire is arranged, and a placement surface of the placement portion on which the distal end portion of the heat-shrinkable tube is placed is located on an arrangement surface side of the terminal on which the wire is arranged, relative to a lower surface of the counterpart connecting portion of the terminal held by the terminal holding portion.

2. The heat-shrinkable tube attachment jig according to claim 1, further comprising a wire holding portion that holds the wire.

3. The heat-shrinkable tube attachment jig according to claim 1, further comprising an end face abutment portion that is abutted against an end face of the heat-shrinkable tube that faces the counterpart connecting portion side of the terminal.

4. The heat-shrinkable tube attachment jig according to claim 1, wherein an opening is formed in a portion that opposes the heat-shrinkable tube.

5. A method for manufacturing a heat-shrinkable tube-equipped wire that uses the heat-shrinkable tube attachment jig according to claim 1, the method comprising:

(a) a terminal holding step of holding the counterpart connecting portion with the terminal holding portion;

(b) a wire holding step of holding the wire with the wire holding portion;

(c) a placing step of placing, on the placement portion, the distal end portion of the heat-shrinkable tube that is located on the counterpart connecting portion side; and (d) a step of heat-shrinking the heat-shrinkable tube, wherein the step (c) includes a step of pressing, against the placement portion, the bottom portion of the terminal on which the wire is arranged, in the terminal-equipped wire held in the step (a) and the step (b), thereby clamping the distal end portion of the heat-shrinkable tube between the bottom portion and the placement portion.

6. A heat-shrinkable tube-equipped wire in which a heat-shrinkable tube is attached to a connecting portion between a wire and a terminal of a terminal-equipped wire, wherein the terminal includes a plate-shaped counterpart connecting portion that is exposed from the heat-shrinkable tube and is integrally molded with the wire connecting portion, a flat surface is formed at a distal end portion of the heat-shrinkable tube that is located on the counterpart connecting portion side, at a portion that comes into contact with a bottom portion of the terminal on which the wire is arranged, and the flat surface of the heat-shrinkable tube is formed at a higher position than a bearing surface, relative to the arrangement surface of the terminal on which the wire is arranged, the bearing surface coming into contact with a connection target area when the counterpart connecting portion is connected to the connection target area via a connecting member.

7. The heat-shrinkable tube-equipped wire according to claim 6, comprising a coupling portion that couples the wire connecting portion of the terminal and the counterpart connecting portion such that the wire connecting portion is located higher than the counterpart connecting portion, relative to the arrangement surface.

* * * * *